US006685065B1

(12) United States Patent
Ebling et al.

(10) Patent No.: US 6,685,065 B1
(45) Date of Patent: Feb. 3, 2004

(54) GARMENT FOLDING AID

(75) Inventors: Gary Ebling, Northfield, MN (US); Michael Farris, Apple, MN (US)

(73) Assignee: Concepts Design and Display, Inc., Northfield, MN (US)

( * ) Notice: Subject to any disclaimer, the term of this patent is extended or adjusted under 35 U.S.C. 154(b) by 0 days.

(21) Appl. No.: 09/982,447

(22) Filed: Oct. 17, 2001

(51) Int. Cl.[7] ..... A41H 33/00
(52) U.S. Cl. ..... 223/38; 223/37
(58) Field of Search ..... 223/37, 38

(56) References Cited

U.S. PATENT DOCUMENTS

| | | | | |
|---|---|---|---|---|
| 702,085 | A | 6/1902 | Barnes | |
| 1,657,551 | A | 1/1928 | Schremp | |
| 4,421,500 | A | * 12/1983 | Smith | 493/405 |
| 5,259,827 | A | 11/1993 | Staniszewski | |
| 5,308,051 | A | 5/1994 | Spitzmesser | |
| 6,015,069 | A | * 1/2000 | Christensen | 223/37 |
| 6,269,987 | B1 | 8/2001 | LaPace et al. | |

* cited by examiner

*Primary Examiner*—John J. Calvert
*Assistant Examiner*—James G Smith
(74) *Attorney, Agent, or Firm*—Clayton R. Johnson

(57) ABSTRACT

The garment folding aid has two bed subassemblies that are laterally telescopically adjustable and retained in selected adjusted positions by detent mechanism. To the remote vertical longitudinal edge portions of the subassemblies there is mounted the lower mounting rails of hinges while the lateral opposite mounting rails of the hinges mount folder flaps. The web of each hinge which extends between its mounting rails resiliently urges the said opposite mounting rails to extend vertically upwardly, the webs being of a greater flexibility than the mounting rails. Hand hold openings are provided in the flaps to facilitate moving the subassemblies to adjust the width of the folding aid. Corner portions of the flaps on one longitudinal end of the subassemblies are cut at an angle to make the flaps more ergonomically friendly when moving the flaps during a garment folding operation.

25 Claims, 4 Drawing Sheets

FIG. 1
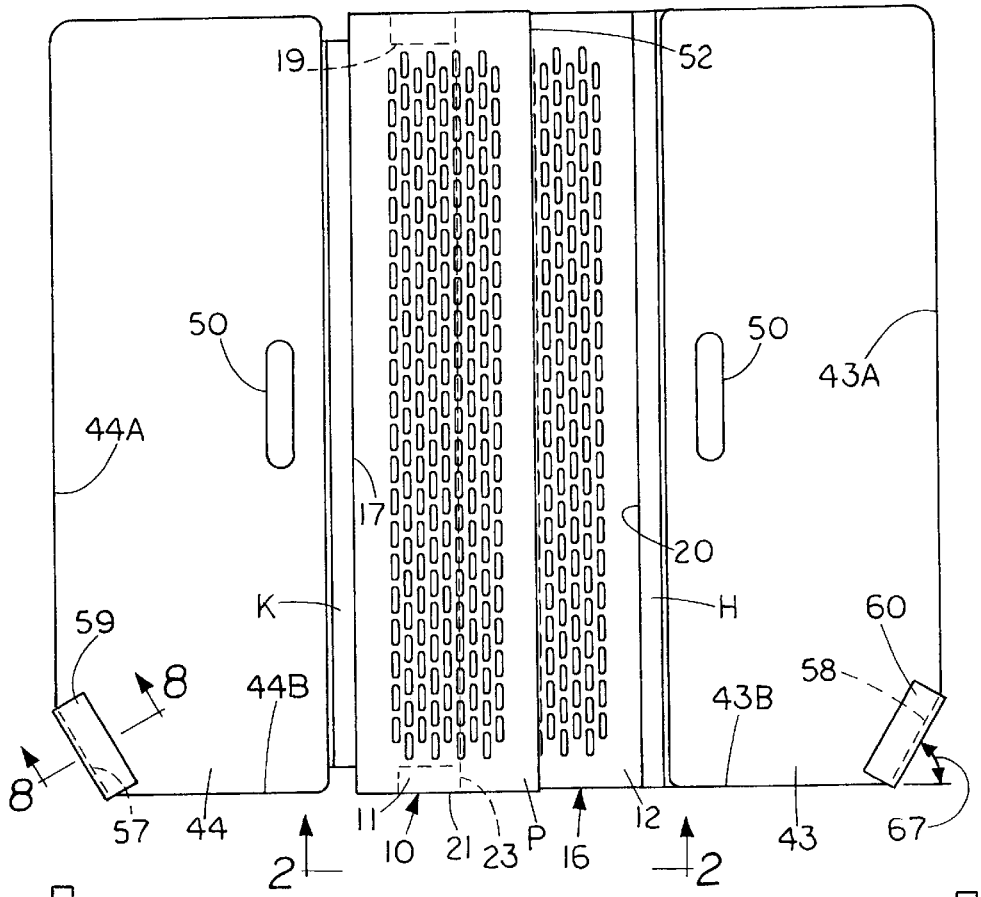
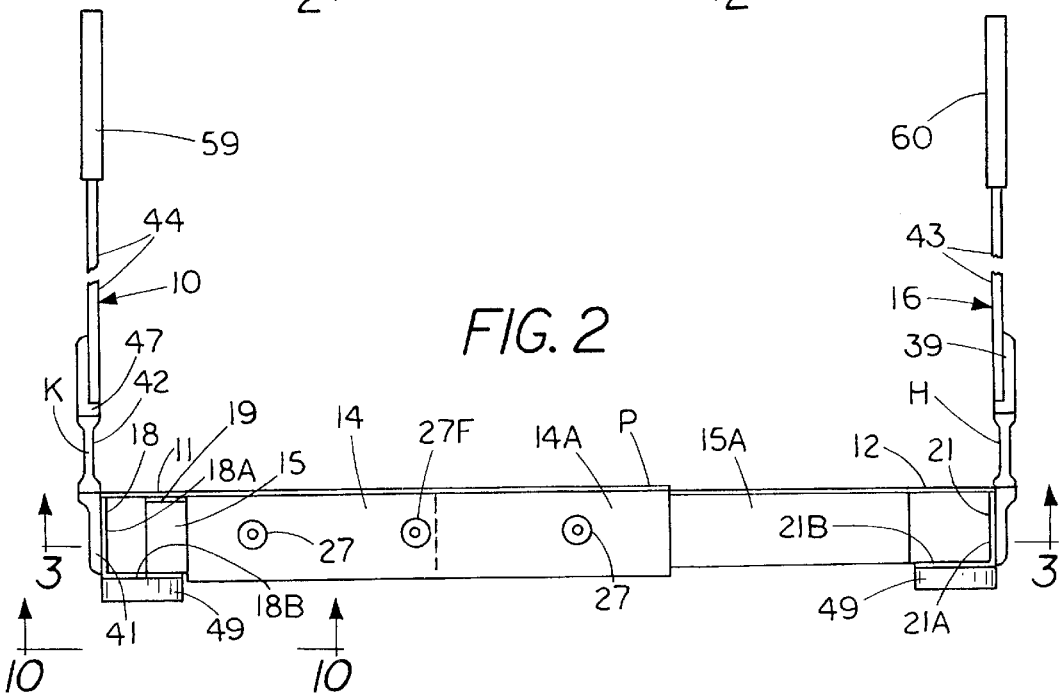
FIG. 2

GARMENT FOLDING AID

BACKGROUND OF THE INVENTION

This invention relates to providing an aid for folding garments such as shirts, sweaters, jackets, slacks etc. and piece goods, for example towels, that can be stored in a generally flat folded condition.

U.S Pat. No. 6,015,069 to Christensen discloses a garment folding table that include slide bars and blocks connected to bed members to permit changing the width of the bed and offset hinges connecting folder arms to the bed members for folding movement. In LaPace et al, U.S. Pat. No. 6,269,987, there is disclosed a folding assembly having an orienting main segment with side segments connected thereto by flexible connectors and extension members. The folding assembly includes a support assembly. As to U.S. Pat. No. 4,421,500 to Smith, there is disclosed a manually operable folding guide that includes a rigid central panel, a pair of folder flaps, an elastic sheet secured to the back of the flaps and the central panel to self retract the flaps and spacers secured to the flaps to facilitate the movement of the users' hands beneath the flaps.

In order to make improvements in devices for folding various articles, including improved bed width adjustment features and hinge features, this invention has been made.

SUMMARY OF THE INVENTION

A garment folding aid for folding garments and piece goods includes a bed assembly that includes a pair of bed subassemblies having central panels and frame members that cooperate therewith to telescopically permit the subassemblies being relatively moved to selected adjusted width positions. The frame members and detent mechanism permit the subassemblies being pulled or pushed to move the subassemblies to the selected adjusted position and retain the subassemblies in the selected adjusted position during normal use in folding articles. Hinge devices mount the folder flaps to the bed subassemblies for movement between a hinged laterally extended position extending outwardly of the bed subassembly to which it is connected and a hinged folded position overlaying at least one of the bed assemblies while resiliently urging the folder flaps to an upstanding position intermediate the above mentioned hinged positions. The panels at one longitudinal ends have corner portions remote from the bed subassemblies cut away with hand holder pads folded thereover and extend at angles to make manual movement of the flaps more ergonomically friendly.

One of the objects of this invention is to provide a garment folding aid having new and novel hinge means for connecting folder flaps to a central bed assembly. In furtherance of the above object, it is another object of this invention to provide hinge means that aid in initially moving a folding flap away from each of a laterally extended position and an article folded position toward the other one of the positions.

A further object of this invention is to provide in a garment folding aid, new and novel means for mounting and retaining bed subassemblies in selected laterally adjusted positions. In furtherance of the last mentioned object, it is a further object of this invention to provide new and novel means for retaining the bed subassemblies in selected adjusted positions while permitting the adjusted position being changed merely by pushing or pulling on folder flaps that are connected to the bed subassemblies.

BRIEF DESCRIPTION OF THE DRAWINGS

FIG. 1 is a plan view of the garment folding aid of this invention with the folder flaps in their spread apart datum position;

FIG. 2 is an end view of the folding aid of FIG. 1, said view being generally taken along the line and in the direction of the arrows 2—2 of FIG. 1 other than the folder flaps are shown as extending at right angles to the central panel members, lateral intermediate portions of the flaps being broken away;

DETAILED DESCRIPTION OF THE PREFERRED EMBODIMENT

Figure 3:
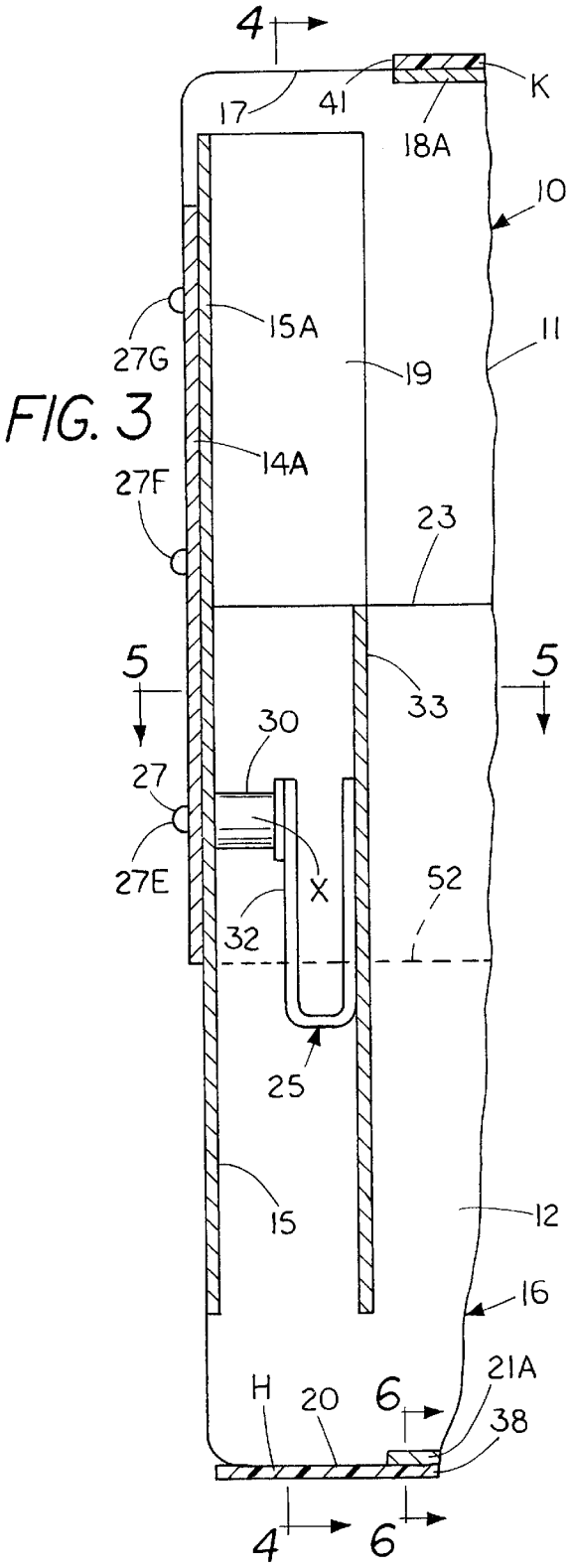
FIG. 3 is an enlarged fragmentary cross sectional view that is generally taken along the line and in the direction of the arrows 3—3 of FIG. 2 to shown the telescopic feature of the folding aid in its maximum width adjusted position.
Figure 4:
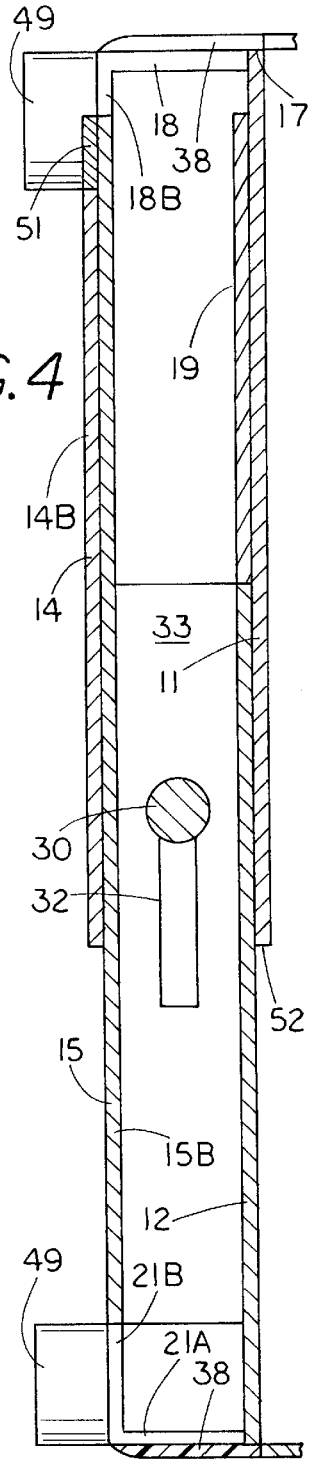
FIG. 4 is a fragmentary cross sectional view that is generally taken along the line and in the direction of the arrows 4—4 of FIG. 3.

The garment folding aid includes a folding bed assembly P having a first subassembly, generally designated 10 and a second subassembly, generally designated 16, that are releasably retained in selected laterally adjustable telescopic relationship to one another to facilitate being used in folding articles of different folding widths. The subassembly 10 includes a central panel 11 while subassembly 16 includes a central panel 12, the panels 1, and 12 being horizontal and at least in partial overlapping relationship. Advantageously, each of the panels 11 and 12 is generally rectangular and is perforated such as indicated in FIG. 1 for reducing static while folding static prone articles and to reduce the weight of the bed assembly To each of the longitudinally opposite lateral edges 21 of the panel 11, there is joined the upper edge of the vertical leg 14A of a laterally extending frame member (right angle bracket) 14 of the subassembly 10 which includes a horizontal leg 14B. The width portions of the legs 14B extend inwardly toward one another from their juncture to the lower edges of the legs 14A. The angle brackets 14 terminate laterally inwardly of the panel longitudinal edge 17 by a dimension about the same as or greater than that of the width of a leg 14B. The frame members 14 in conjunction with the part of panel 11 that overlies legs 14B form generally U shaped channels that open longitudinally toward one another.

To each of the longitudinally opposite lateral edges of the panel 12, there is joined the vertical leg 15A of a frame member (right angle bracket) 15 that also has a horizontal leg 15B. The lateral length of each of the angle brackets 15 is substantially greater than that of angle brackets 14, for example at least half again that of frame members 14. Advantageously, the one lateral ends of the frame members 15 are spaced from the longitudinal edge 20 of the panel 12 by a dimension about as great as the width of legs 15B. To the longitudinal edge 23 of the panel 12 opposite the edge 20 there are joined longitudinally spaced extensions (frame members) 19 that are coplanar with panel 12, of lateral lengths to extend laterally away from panel 12 in a direction away from edge 20 as far as frame members 15, of widths of about the same as legs 15B and are joined to the upper edges of legs 15A to be in overlaying relationship to the respective leg 15B. The extensions and panel 12 may be formed as a single unitary piece, for example by cutting away a rectangular part from a single piece of material to provide the panel and extensions.

Figure 5:
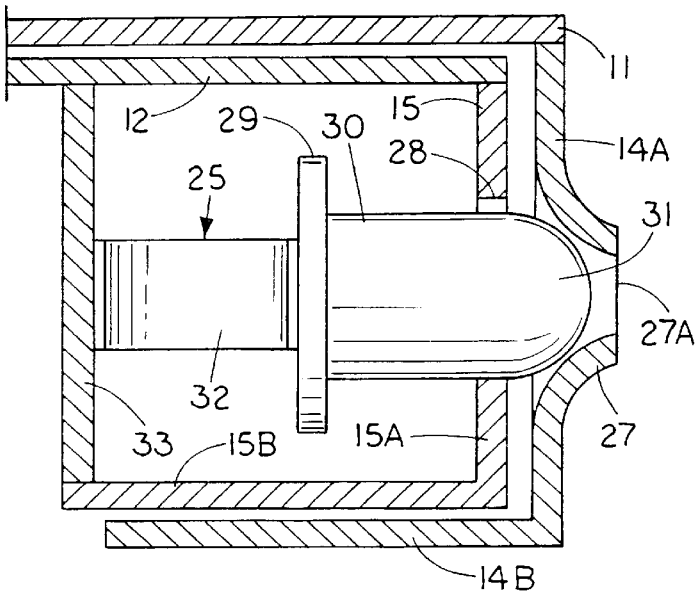
FIG. 5 is a further enlarged fragmentary cross sectional view that is generally taken along the line and in the direction of the arrows 5—5 of FIG. 3.

Frame members 15 which form part of the subassembly 16, other than for lateral lengths, are generally the same as frame members 14 so as to, in conjunction with the adjacent part of panel 12 and extensions 19, form generally U-shaped channels with the frame members 15 being telescopically extended into the channels formed by frame members 14 and panel 11 such as is in part shown in FIG. 5.

To the longitudinal edge 17 of the panel 11 that is laterally opposite panel 12, there is a longitudinal frame member (angle bracket) 18 that has the upper edge of its vertical leg 18A joined to the panel 12 and its horizontal leg 18B joined to the lower edge of leg 18A to extend in underlaying relationship to panel 11 (see FIGS. 2–4 and 10). Advantageously, the panel 11 in a lateral direction away from panel 12, extends further laterally away from brackets 14 by a dimension slightly greater than the width of the frame member leg 18B. Similarly, to the longitudinal edge 20 of the panel 12 that is laterally opposite panel 11, there is a longitudinal frame member 21 that has the upper edge of its vertical leg 21A joined thereto and its horizontal leg 21B joined to the lower edge of leg 21A to extend toward leg 188 in underlaying relationship to panel 12 (see FIGS. 2 and 4). Advantageously, the panel 12 in a lateral direction away from panel 11, extends further laterally away from brackets 15 in a direction away from edge 23 by a dimension slightly greater than the width of frame member legs 21A. The angle bracket 19 is of a longitudinal length that is at least slightly less than the lateral spacing of bracket legs 15B so that the bed subassemblies can be adjustably moved to have angle bracket 18 located longitudinally between the brackets 15 when the subassemblies are in at least one of their minimum width positions.

Frame members 18 and 21 are parts of the subassembly 10 and 16 respectfully with their legs 18A, 23A having remote, generally vertical surfaces that are parallel to one another. To each of the horizontal legs of the angle brackets 21, 28, there is dependingly mounted a pair of longitudinally spaced feet 49 to support the folding aid on a support surface 48, for example a table.

In order to retain the subassemblies 10, 16 in selected laterally adjusted positions, on each of the longitudinal ends of the subassemblies, there is provided a detent mechanism, generally designated 25, that includes a plurality of laterally spaced detent dimples (detent punch outs) 27 in each of the frame member legs 14A (see FIGS. 3 and 5). Each dimple portion 27 provides an aperture 27A that opens longitudinally outward in a direction from the opposite frame leg 14A and is of progressively decreasing inner diameters in said outward direction. Longitudinally alignable with each of the dimple apertures is an aperture 28 in each leg 15A that advantageously is of a diameter that is intermediate the maximum and minimum diameters of the apertures 27A.

The detent mechanism also includes a longitudinally elongated detent X having an enlarged diameter head portion 29 that is joined to one axial end of a smaller diameter cylindrical portion 30, the axial opposite end of which is joined to the base of the generally semi-spherical portion 31. The detent head is of a larger diameter than that of aperture 28 while the cylindrical portion and the axial adjacent part of the semi-spherical portion 31 is of a larger diameter than the axial intermediate part of the aperture 27A. Thus, the semi-spherical portion is axially extendable into the portion of the detent dimple that is adjacent to the respective leg 15A, but is not movable axial outward therethrough.

One end of a spring 32 is joined to the detent head and has its opposite end portion joined to the lateral elongated bar 33 which has one edge joined to the edge of the leg 15B which is remote from the leg 15A and an opposite edge joined to the underside of the panel 12. Advantageously, as viewed from the top, the spring is generally U-shaped. The springs constantly resiliently urge the detents into engagement with the adjacent legs 14A and into the dimple apertures when longitudinally aligned therewith, but permit the detents moving out of the dimpled apertures when sufficient lateral forces is applied through the central panels and therethrough to the legs 14A, 15B to move the legs laterally relative to one another. With the detent mechanism X at each longitudinal end of the subassemblies, the lateral dimension of the bed assembly may be easily adjustably retained in one of three different lateral positions, provided each bracket leg 14A has three dimples 27.

To each of the longitudinal frame member legs 18A and 21A, there is joined by, for example rivets 37 and/or glue, the lower longitudinally elongated mounting rails 38, 41 of the hinges H and K respectively. The surface of the mounting rail 38 which abuts against the leg 21A is planar as is adjacent surface of the leg 21A. Advantageously, as viewed in FIG. 6, the height of the planar surfaces of the leg 21A and hinge rail is about ¾" to 1 and ¾". The hinges H and K are of the same construction other than hinge H may be of a greater length than hinge K.

The hinge T is desirably longitudinally elongated to extend the length of the longitudinal leg 21A. As viewed in FIG. 6, the upper part 38A of the mounting rail 38 is of a greater thickness than the portion therebeneath. Further, the hinge H has a longitudinal elongated mounting rail 39 spaced from and generally parallel to the adjacent mounting rail 38. The mounting rail 39 has a cutout 40 with a folder flap 43 extended into the cutout and joined to the adjacent part of mounting rail 39, for example by gluing. Similarly, to the mounting rail 41 of the hinge K which is mounted to the leg 18A has a cut out portion, there is joined a folder flap 44 that extends in the cut out.

The hinge H includes a web 45 extending the longitudinal length of each of the mounting rails 38, 39 and has a thickened portion 45A joined to thickened part 39A of mounting rail 39, an opposite thickened portion 45B joined to thickened part 38A of mounting rail 38 and a web portion 45C joined to and extending between thickened portions 45A and 45B. The thickness of the major portion of the web (web portion 45C) along the longitudinal length thereof and intermediate portions 45A, 45B is less than about half of that of the thickened parts 38A, 39A adjacent to their juncture thereto, but of a width dimension (height dimension as viewed in FIG. 6), many times greater than the corresponding dimension of each of the width portions 45A, 45B, for example at least 5 times as great. Advantageously, the width of the web portion 45C is about one-half inch and about 4 to 5 times as great as its thickness. The hinge K has a web 42 and mounting rails 41, 47 that are the same as the web 45 and mounting rails 39, 38 of hinge H other than being of shorter longitudinal dimensions.

Figure 6:
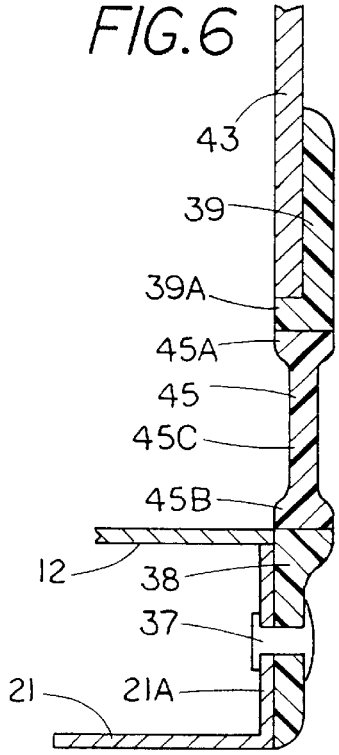
FIG. 6 is an enlarged fragmentary cross sectional view that is generally the same as that of FIG. 5 other than a folder flap, only part of which is shown, is in the position shown in FIG. 2.
Figure 7:
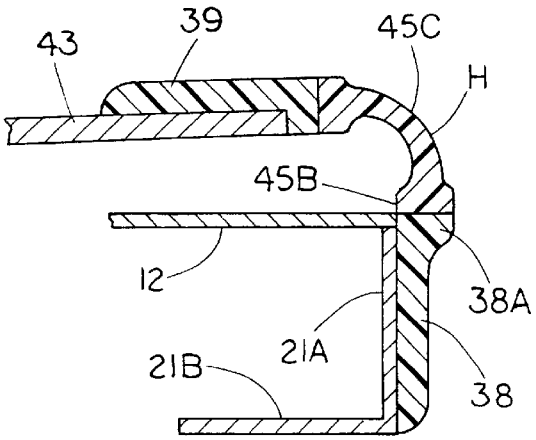
FIG. 7 is a fragmentary cross sectional view that is generally the same as that shown in FIG. 6 other the folder flap, only part of which is shown, is in a folded position.
Figure 8:
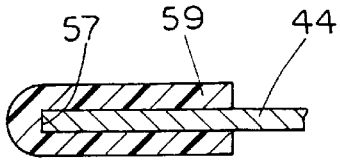
FIG. 8 is a fragmentary view that is generally taken along the line and in the direction of the arrows 8—8 of FIG. 1 that shows the hand hold on a corner portion of a folder flap.
Figure 9:
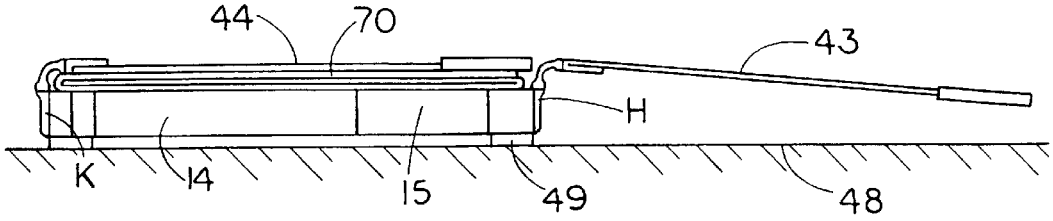
FIG. 9 is a diagrammatric showing of the folding aid with one folder flap in its datum position and the other in a folded position relative to a garment.
Figure 10:
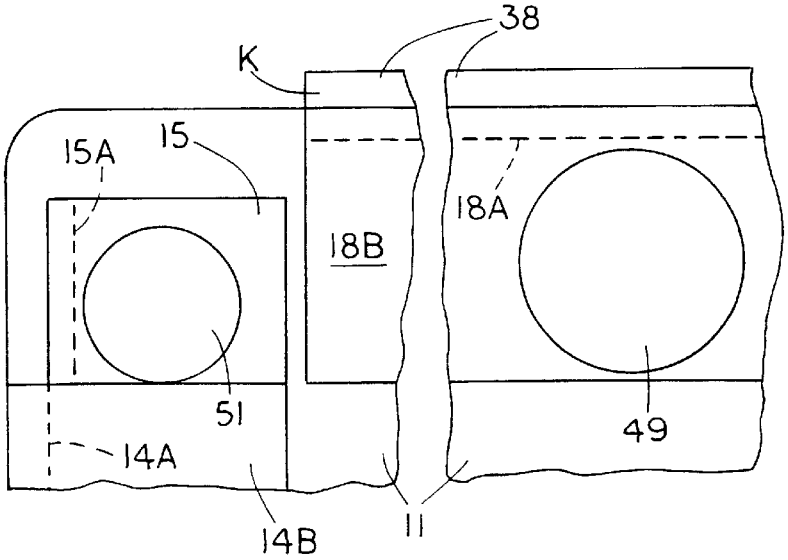
FIG. 10 is a fragmentary bottom view of a corner portion of the folding aid that is generally taken away the line and in the direction of the arrows 10—10 of FIG. 2.

Advantageously, the height of each of the mounting rails as viewed in FIG. 6 are of substantially the same dimensions and only slightly greater than that of the webs. The mounting rails 38, 39 are of a relatively rigid construction as contrasted to the web 45. The web 45 is of a resiliency, that when the hinge lower portion is mounted to the respective one of bracket legs 18A, 21A and no folder flap connected thereto, the hinge will extend substantially vertically such as shown in FIG. 6. Thus, the web of each hinge is of a resiliency to urge the panel to which the hinge is connected toward a generally vertical condition such as shown in FIG. 2. Further, when the folder flap is in its open datum (laterally extended) position, the hinge resiliently retains the flap to which it is joined to extend predominately laterally outwardly from the adjacent central panel portion while extending downwardly toward the surface 48 on which the frame member feet 49 rest. Additionally, each hinge is of a resiliency that the respective flap may be moved to be incline downwardly from which the hinge is joined to abut against the panel that is remote from the hinge.

Preferably each hinge is of an extruded construction where each of portions 38, 39, 41 and 42 is made of PVC (polyvinyl chloride) while the webs 45, 42 are made of an thermoplastic elastomer (TPE). Each hinge is a single piece extrusion such that the respective web is joined at its opposite edges to the mounting rails 38, 39 and 41, 47 respectively along their entire lengths. The mounting rails of each hinge may be manually moved apart a very limited amount without damaging the hinge due to the limited elasticity of the web along its width and being able to move the one ends of the rails apart a very limited amount without moving the other ends of the rails apart. The web of each hinge is of a resiliency to permit moving the panels as has been and will be indicated while at the same time having a memory to constantly urge the panels toward their position extending at generally right angles to the central panels such as shown in FIG. 2. As an example of the flexibility of the hinge, when one longitudinal end portion is supported on a horizontal surface and an unsupported longitudinal length of the hinge is 24 inches, the hinge deflects such that the opposite longitudinal end of the hinge is 3 and 3/16th's of an inch below the supporting surface.

To facilitate extending the bed subassemblies from one of their smaller width adjusted positions to a greater width adjusted positions, or from each of the greater width adjusted positions to a small width adjusted position, each of the folder flaps is provided with a hand hold opening 50 that is generally longitudinally centered and transversely closely adjacent to the respective hinge to which the folder flap is connected without extending through the hinges. Advantageously, the hand hold openings are sufficiently close to the respective hinge such that with the users extending their hands through the hand holds openings, their fingers are abuttable against the hinge mounting rails. To adjust the width of the garment folding unit, the users extend their hands into the hand hold openings together with lifting one longitudinal edge of one of the subassemblies off the supporting surface 4R and pushes or pulls flaps laterally toward or away from one another.

The maximum width of the folding aid is limited by stops 51 that are dependingly mounted to the end portions of bracket legs 15B that are remote from panel 12. In the maximum width position, the stops abut against the longitudinal edge of the adjacent leg 14B that is remote from panel edge 20. When legs 14B abut against or are closely adjacent to the stops, the detents extend into the detent dimples 27E that are most remote from edge 17. At this time the bed assembly is in its maximum width adjusted position and remains in such a position during normal use.

The adjustment of subassemblies in a minimum width direction is limited by the longitudinal edge 52 of panel 11 abutting against the hinge H that is joined to bracket leg 21A. When the panel 11 abuts against the hinge H or is closely adjacent thereto, the detents extend into the detent dimples 27G that are mostly closely adjacent to the longitudinal panel edge 17. There may be one or more intermediate adjusted positions, for example by having detent dimples 27F for the detents to extend into, or one or more pairs of additional detent dimples.

The radii of curvature of the inner surface of each of the dimple portion 27B in combination with the radius of curvature of detent semi-spherical portion 31 is such that as a force is exerted on the subassemblies to move the edges 17, 20 toward one another, the detents are forced out of the respective dimple and slide over the surfaces of legs 14A lateral between adjacent dimples, and if the detents are moved laterally toward other dimples, as the detents move adjacent to the said other dimples, the detents move into the dimple apertures such as shown in FIG. 5. The springs 32 are of characteristics to retain the subassemblies in the selected adjusted position during normal folding operations, but the subassemblies are laterally adjustable by manually pushing the subassemblies together or pulling them apart with the detents moving out of the adjacent dimples as a result of exerting such manual forces on, for example on the folder flaps.

At one longitudinal end of the folding aid, the corner portions of the folding flaps 43, 44 are cut away along lines 58, 57 respectively to provide a corner edge intersecting the folder flap longitudinal edge 43A, 44B respectively and the lateral edge 43B, 44B to extend at an included angle of about 115 degrees to 125 degrees relative to the respective lateral edge, and preferably extend at angles 67 of about 60 degrees relative to the adjacent lateral edge of the respective flap.

Folded over the corner cut portions of the flaps 43, 44 are generally rectangular hand hold pads 60, 59 respectively that advantageously are made of a plastic material, for example PVC (polyvinyl chloride). The angles of extension of the edges 57, 58 and corresponding extension of the folded over portions of the hand holds pads are generally aligned with the natural line of the user's wrist and arms to make the use of the folding aide more ergonomically friendly. The thickness of the handholds prior to folding may be about an eighth to a quarter of an inch. The folded over length and width dimension of each hand hold pad (handle) is sufficiently great that when the reversely folded portion of each hand hold abuts against the juncture of the thumb to the forefinger, the fingers and the thumb abut against opposite parts of the hand hold pads when the flap is manually moved between its datum and folded positions.

Advantageously, the panel 11 in each of its laterally adjusted positions overlies at least part of the portion of panel 12 that is remote from edge portion 20 and closely adjacent thereto, if not in abutting relationship thereto. Further, each of the subassemblies, other than for spring mounts 33, may be made of a single piece of metal by perforating and bending the respective piece to form a central panel and the angle brackets that depend from the central panel.

In using the garment folding aid, with the bed assembly in a selected width adjusted position and the folder flaps in their datum position, the garment, or other item to be folded, 70 is positioned on the folding aid and then, for example, folder flap 43 is moved to its folded position and back to its datum position, and thence the folder flap 44 is moved to its folder position and returned to its datum position. Thereafter, the folded garment is removed from the garment folding aid. The resiliency of the hinge webs act to aid in moving the flaps from each of their folded and datum positions.

What is claimed is:

1. An article folding assembly, comprising a bed assembly having laterally opposite longitudinal first and second edge portions, a first folder flap, a second folder flap, first means for hingedly connecting the first folder flap to the first edge portion to constantly resiliently urge the first folder flap to extend generally vertically upwardly relative to the bed assembly while at rest and permitting the first folder flap being moved between a datum position extending laterally outwardly of the bed assembly and a folded position at least in part in overlaying relationship to the bed assembly, and second means for hingedly connecting the second folder flap to the second edge portion to constantly resiliently urge the second folder flap to extend generally vertically upwardly relative to the bed assembly while at rest and permitting the second folder flap being moved between a datum position extending laterally outwardly of the bed assembly and a folded position at least in part in overlaying relationship to the bed assembly.

2. The article folding assembly of claim 1 wherein each of the first and second folder flaps has a longitudinal edge remote from first and second means respectively, a lateral edge and a corner edge intersecting the folder flap longitudinal edge and the lateral edge to extend at an included angle of about 115 degrees to 125 degrees relative to the lateral edge and a hand hold pad folded over the corner edge.

3. The article folding assembly of claim 1 wherein the bed assembly includes a general horizontal panel having the first edge portion and a longitudinally elongated leg dependingly joined to the first edge portion and having a longitudinally elongated, generally vertical surface and the first means is mounted to the leg and has a longitudinally elongated portion mounted to the leg to extend vertically in abutting relationship to said surface.

4. The article folding assembly of claim 1, wherein each of the first and second edge portions of the bed assembly is longitudinally elongated and has a vertical surface laterally remote from the vertical surface of the other edge portion and the first means includes a longitudinally elongated hinge having a first longitudinal edge portion secured to the bed assembly first edge portion in abutting relationship to the bed assembly first edge portion vertical surface, a second longitudinally elongated edge portion secured to the first flap and a web portion extending between and joined to the hinge first and second edge portions to resiliently urge the hinge second edge portion to extend vertically above the bed assembly.

5. The article folding assembly of claim 4 wherein the web is of a much greater resiliency than that of each of the hinge edge portions and that the vertical surfaces are generally parallel to one another.

6. The article folding assembly of claim 4 wherein the hinge edge portions are made of PVC and the web of a thermoplastic elastomer.

7. The article folding assembly of claim 1 wherein the bed assembly includes a first and second subassemblies respectively having the first and second edge portion, the subassemblies having cooperating means for telescopically connecting the subassemblies to one another to permit adjusting the lateral spacing of the first and second edge portions relative to one another.

8. The article folding assembly of claim 7 wherein the first subassembly includes a first central panel having the first longitudinal edge portion and longitudinally opposite lateral edge portions and the second subassembly includes a second central panel having the second longitudinal edge portion and longitudinal opposite second lateral edge portions, each of the panels having hand hold openings adjacent to the respective hinges to facilitate manually pushing the flaps toward one another to act through the hinges to move the subassemblies to decrease the spacing of the first and second longitudinal edge portions toward one another and alternately to pull the flaps laterally away from one another to move the subassemblies to vary the lateral spacing of the first and second longitudinal edge portions relative to one another.

9. The article folding assembly of claim 7 wherein the first subassembly includes a first central panel having the first longitudinal edge portion and longitudinally opposite lateral edge portions and means for, in conjunction with the last mentioned lateral edge portions, provide first channels that open toward one another and the second subassembly includes a second central panel having the second longitudinal edge portion and longitudinally opposite lateral edge portions and means for, in conjunction with the last mentioned lateral edge portions, provide second channels that open toward one another and telescopically extend into the first channels.

10. The article folding assembly of claim 9 wherein the second channels telescopically extend in the first channels and there; is provided cooperating means on the first and second channels to retain the panels in selected laterally adjusted positions.

11. The article folding assembly of claim 10 wherein the cooperating means includes detent means for releasably retaining the means for respectively providing the first and second channels in preselected laterally adjusted positions to selectively vary the lateral dimension of the bed assembly.

12. The article folding assembly of claim 11 wherein the detent means includes a plurality of laterally spaced detent dimples in the mean for providing the first channel, a detent and means for cooperating with the means for providing the second channel to resiliently urge the detent into the adjacent detent dimple while permitting the detent moving out of the adjacent detent dimple when a manual force is applied to the subassemblies to move subassemblies laterally relative to one another to selected adjusted positions.

13. The article folding assembly of claim 12 wherein the second means for providing the second channel includes a laterally elongated right angle bracket having a horizontal leg underlaying the second panel and the means for cooperating with the means for providing the second channel includes a laterally elongated spring mount joined to the second panel and the horizontal leg with the detent longitudinally between the spring mount and the means for providing the first channel and spring means mounted to the spring mount for mounting and constantly urging the detent toward the means for providing the first channel.

14. The article folding assembly of claim 12 wherein the subassemblies in each of the adjusted position, the first panel extends in overlaying relationship to at least part of the second panel.

15. An article folding assembly, comprising a folding bed having longitudinally elongated first and second bed subassemblies that respectively have first and second central panels with longitudinal edge portions laterally remote from one another and longitudinally opposite first and second lateral opposite edges, laterally elongated first and second brackets dependingly mounted to the first and second first panel lateral edges respectively for respectively forming a first and second lateral channel, and first and second means for permitting selectively adjusting the lateral width of the bed, the first and second means being laterally elongated, dependingly mounted to the first and second panel lateral edges respectively of the second panel and telescopically extending into the first and second channel respectively, a first folder flap, means for hingedly mounting the first flap for movement between a position that at least in part overhangs the first panel and a second position extending laterally outwardly of the subassemblies and being mounted to the first subassembly longitudinal edge portion, a second folder flap and means for hingedly mounting the second flap for movement between a first position that at least in part over hangs the second panel and a datum position extending laterally outwardly of the subassemblies and being mounted to the second subassembly longitudinal edge portion.

16. The article folding assembly of claim 15 wherein the first and second means respectively includes a third and fourth bracket and detent means is mounted to at least one of the third and fourth brackets to act in cooperation with at least one of the first and second brackets to retain the panels in selected laterally adjusted positions.

17. The article folding assembly of claim 16 wherein the first bracket has a laterally elongated leg with laterally spaced detent dimples extending longitudinally away from the second bracket that in part defines the detent means, the first means includes a laterally extended second leg extending along and adjacent to the first leg and having an aperture opening to the first leg, and the detent means includes a detent mount mounted to the first means to move therewith, a detent extending though said aperture and movable into abutting relationship to a detent dimple and spring means mounted to the spring mount to resiliently urge the detent into a detent dimple when laterally adjacent thereto and moving out of the detent dimple when a manual lateral force is applied to the subassemblies to intentionally move one laterally relative to one another.

18. The article folding assembly of claim 17 wherein the second leg is joined to a second panel lateral edge to depend therefrom, the first means includes a horizontal leg joined to the second leg in spaced relationship to and below the second panel and the panel mount is joined to the horizontal leg and the second panel, and the first bracket has a horizontal leg extending in underlying relationship to the second horizontal leg.

19. The article folding assembly of claim 16 wherein a longitudinally elongated leg is joined to the first panel longitudinal edge portion and has a longitudinally elongated vertical surface extending below the first panel and the means for hingedly mounting the first flap includes a longitudinally elongated first mounting rail mounted to the leg and having a generally vertical surface in abutting relationship to the leg vertical surface, a second mounting rail extending generally parallel to the first mounting leg and means for resiliently urging the second leg to extend vertically above the first leg and extending between the first and second leg.

20. An article folding assembly, comprising a bed assembly having laterally opposite longitudinal first and second edge portions, a first folder flap, a second folder flap, means for hingedly connecting the first folder flap to the first edge portion to permit the first folder flap being moved between a datum position extending laterally outwardly of the bed assembly and a folded position that at least in part is in overlaying relationship to the bed assembly, means for hingedly connecting the second folder flap to the second edge portion to permit the second folder flap being moved between a datum position extending laterally outwardly of the bed assembly and a folded position that at least in part is in overlaying relationship to the bed assembly, each folder flap having a longitudinal edge remote from the respective means that connects it to the bed assembly edge portion, a lateral edge aligned with the other folder flap, and a hand hold corner edge that extends between the lateral edge and longitudinal edge at an included angle of about 115 degrees to 125 degrees with the lateral edge and a hand hold pad reversely bent over each corner edge.

21. The article folding assembly of claim 20 wherein the bed assembly includes first and second bed subassemblies that respectively have first and second central panels with the first and second longitudinal edge portions respectively laterally remote from one another, and means for cooperating with the first and second panels to telescopically connect the panels to one another with one in at least partial overlapping relationship to the other and selectively varying the lateral width of the bed.

22. For a garment folding aid that has a bed assembly with a longitudinal edge portion and a folder flap, a hinge having a first longitudinally elongated mounting rail adapted for being joined to the bed assembly longitudinal edge portion, a second longitudinally elongated mounting rail adapted for being joined to the folder flap and a longitudinally elongated web having a first longitudinal edge portion joined to the first mounting rail and a second longitudinal edge portion joined to the second mounting rail to resiliently urging the second mounting rail to a predetermined position relative to the first mounting rail, the web being of a greater resiliency than the rail portions.

23. The hinge of claim 22 wherein the mounting rails are made of polyvinyl chloride and the web is made of a thermoplastic elastomer and the mounting rails and web are of a single piece extrusion.

24. An article folding assembly, comprising a bed assembly having a horizontal panel and laterally opposite longitudinal first and second edge portions, a first folder flap, a second folder flap, a first hinge connecting the first folder flap to the first edge portion and constantly resiliently urging the first folder flap to extend generally vertically upwardly relative to the horizontal panel while at rest and permitting the first folder flap being moved between a datum position extending laterally outwardly of the bed assembly and a folded position at least in part in overlaying relationship to the bed assembly and a second hinge connecting the second folder flap to the second edge portion and constantly resiliently urging the second folder flap to extend generally vertically upwardly relative to the horizontal panel while at rest and permitting the second folder flap being moved between a datum position extending laterally outwardly of the bed assembly and a folded position at least in part in overlaying relationship to the bed assembly.

25. The article folding assembly of claim 24 wherein the panel has the first edge portion and the bed assembly includes a longitudinally elongated leg dependingly joined to the first edge portion and having a longitudinally elongated, generally vertical surface and the first hinge includes a first longitudinally elongated mounting rail mounted to the leg in abutting relationship to said surface, a second longitudinally elongated mounting rail mounted to the folder flap and a longitudinally elongated web having a first longitudinal edge portion joined to the first mounting rail and a second longitudinal edge portion joined to the second mounting rail to constantly resiliently urge the second mounting rail to extend vertically above the first mounting rail, the web being of a greater resiliency than the rail portions.

* * * * *